US007165947B2

(12) United States Patent
Hattori et al.

(10) Patent No.: US 7,165,947 B2
(45) Date of Patent: Jan. 23, 2007

(54) SCREW COMPRESSOR CAPABLE OF MANUALLY ADJUSTING BOTH INTERNAL VOLUME RATIO AND CAPACITY AND COMBINED SCREW COMPRESSOR UNIT ACCOMMODATING VARIATION IN SUCTION OR DISCHARGE PRESSURE

(75) Inventors: Toshiro Hattori, Tokyo (JP); Katsuyuki Takahashi, Tokyo (JP); Kiyoshi Tanaka, Tokyo (JP); Akira Matsui, Tokyo (JP); Yoshiyuki Kobayashi, Tokyo (JP); Harumi Sato, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 484 days.

(21) Appl. No.: 10/798,879

(22) Filed: Mar. 12, 2004

(65) Prior Publication Data

US 2004/0234381 A1 Nov. 25, 2004

Related U.S. Application Data

(63) Continuation-in-part of application No. 10/386,112, filed on Mar. 12, 2003, now Pat. No. 6,881,040, and a continuation-in-part of application No. 09/783,133, filed on Feb. 15, 2001, now Pat. No. 6,659,729.

(51) Int. Cl.
*F04B 43/12* (2006.01)

(52) U.S. Cl. ..... 417/53; 417/282; 418/1

(58) Field of Classification Search ..... 417/53, 417/12, 282, 299
See application file for complete search history.

(56) References Cited

U.S. PATENT DOCUMENTS

| | | | | |
|---|---|---|---|---|
| 4,149,827 | A * | 4/1979 | Hofmann, Jr. | 417/12 |
| 4,544,333 | A * | 10/1985 | Hirano | 417/299 |
| 4,548,549 | A * | 10/1985 | Murphy et al. | 417/53 |
| 4,609,329 | A * | 9/1986 | Pillis et al. | 417/282 |
| 4,812,110 | A * | 3/1989 | Kubo et al. | 418/1 |
| 5,606,853 | A * | 3/1997 | Birch et al. | 60/39.281 |

* cited by examiner

*Primary Examiner*—Thor S. Campbell
(74) *Attorney, Agent, or Firm*—Crowell & Moring LLP

(57) ABSTRACT

A screw compressor is equipped with a manually operated internal volume ratio adjusting slide valve and capacity adjusting slide valve. The compressor is simple in construction, can be produced with low cost, can accommodate decrease in suction pressure, for example, in an aged gas well, and can be operated without an electric power source for controlling the operation thereof. Also a combined screw compressor unit consisting of a plurality of screw compressors for producing high discharge pressure is provided which can accommodate high suction pressure in order not to overload the higher pressure compressor or compressors with the efficiency of the unit kept as high as possible by including at least a screw compressor according to the present invention in the unit.

5 Claims, 4 Drawing Sheets

SCREW COMPRESSOR CAPABLE OF MANUALLY ADJUSTING BOTH INTERNAL VOLUME RATIO AND CAPACITY AND COMBINED SCREW COMPRESSOR UNIT ACCOMMODATING VARIATION IN SUCTION OR DISCHARGE PRESSURE

CROSS-REFERENCE TO RELATED APPLICATION

This is a continuation-in-part application of U.S. Ser. No. 10/386,112 filed on Mar. 12, 2003.

BACKGROUND OF THE INVENTION

1. Field of the Invention

The present invention is related to a screw compressor capable of manually adjusting internal volume ratio and capacity (the flow rate of discharge gas) thereof and a combined screw compressor unit suitable for application in the case the suction pressure or discharge pressure varies widely when used for compressing and supplying gas for a refrigerating machine, air conditioner, gas turbine booster, natural gas pipe line, chemical process, spherical holder, etc.

2. Description of the Related Art

A screw compressor equipped with a slide valve for adjusting internal volume ratio and an unloader valve for varying the volume of gas to be sucked, is widely used as a low-noise, low-vibration, relatively low-priced compressor which can be adjusted of the compression ratio and flow rate thereof in accordance with use and operation conditions.

FIG. 5 shows schematically an example of the construction of conventional screw compressor equipped with a slide valve for adjusting internal volume ratio and an unloader valve (a slide valve for adjusting capacity, i.e. flow rate). In this example, both the internal volume ratio adjusting slide valve and capacity adjusting slide valve are driven to slide by hydraulic pressure.

In FIG. 5, reference numeral 101 is a rotor casing, 192 is a suction side bearing housing, 103 is a discharge side bearing housing, 104 is a cylinder, 105 is a rotor drive shaft, 106 is a rotor chamber, 107 is a suction port, 108 is discharge port. A male rotor and a female rotor not shown in the drawing are accommodated in the rotor casing 101 to mesh with each other and supported by bearings in the suction side and discharge side bearing housings. A drive machine such as an electric motor or engine is connected to the rotor drive shaft 105 to rotate the male rotor. The gas to be compressed is sucked from the suction port 107 to be introduced into the enclosed space between the tooth of the male rotor and that of the female rotor, then compressed as the rotors rotate to be discharged from the discharge port 108.

Reference numeral 111 is a capacity adjusting slide valve, 112 is an internal volume ratio adjusting slide valve. Both the slide valves have faces running along the outer perimeters of the male and female rotors, these faces forming part of the wall of the rotor chamber 106. The capacity adjusting slide valve 111 is fixed to the rod 113, the slide valve 111 being provided with a cut 111*a* for defining a radial port. The internal volume ratio adjusting slide valve 112 is fixed to a hollow rod 114 which is received in the rod 113 for sliding. The cylinder 104 is partitioned into a cylinder chamber 121 and a cylinder chamber 120 with a partition 102*a* of the central part of the suction side bearing housing 102, a partition 104*a* in the cylinder 104, and a cover 109. The rod 113 extends penetrating the partition 104*a* to the cylinder chamber 120 to be connected with a piston 115 for driving the capacity adjusting slide valve 111. The hollow rod 114 extends penetrating the partition 102*a* to the cylinder chamber 121 to be connected with the piston 116 for driving the internal volume ratio adjusting slide valve 116. The cylinder chamber 120 is divided into two rooms of left and right, into or from each of which oil is supplied or exhausted from oil inlet or outlet ports not shown in the drawing to move the piston left or right in order to slide the slide valve 111 or 112 connected to the piston 115 or 116 by means of the rod 113 or 114. The rod 113 for sliding the capacity adjusting slide valve 111 is provided with a long center hole at the right part thereof and a rod 117 is inserted into said long center hole, the rod 117 being provided with a spiral groove 123, a pin (not shown in the drawing) protruding radially inwardly from the center hole being received in the spiral groove 123, so that the movement of the rod 113 to the left or right, namely the slide of the capacity adjusting slide valve 111 is converted into the rotation of the rod 117 to be indicated by the unloading valve indicator 118.

In FIG. 5 is shown the condition when internal volume ratio is at the maximum and capacity (flow rate) is at the maximum (full load). If the piston 115 is moved to the left in this condition, the capacity adjusting slide valve 111 is moved to the left to move away from the mating plane 119 of both slide valves and there develops a clearance between the end faces of both slide valves. Apart of the gas sucked and filled in the space between the teeth rotors leaks out, before the space is shut by the right side edge line along the outer perimeter of the teeth of the rotors to enclose the gas, through the clearance to a room 122 to be returned to the suction port 107 through a passage not shown in the drawing. Therefore, the volume of the gas enclosed in the space between teeth is reduced and the amount of discharged gas is reduced.

If both the slide valves are moved to the right by hydraulic pressure with both slide valves contacting, the cut 111*a* of the capacity adjusting slide valve 111 enters the rotor chamber, so the radial port is opened. The more the slide valves moved to the right, the faster the radial port opens. So the more the slide valves moved to the right, the smaller becomes internal volume ratio. When hydraulic pressure is applied on the right side of the piston 115 to move the capacity adjusting slide valve 111 to the left in the condition internal volume ratio is small, the capacity adjusting slide valve 111 is moved to the left to move away from the mating plane 119 of both slide valves and there develops a clearance between the end faces of both slide valves, and the amount of discharge gas is reduced by the same reason mentioned before. With the construction like this, capacity (flow rate) can be adjusted with arbitral inner volume ratio.

According to the construction of above example, both the internal volume ratio adjusting slide valve and the capacity adjusting slide valve are slid by hydraulic pressure, however, there is a type in which the internal volume ratio adjusting slide valve is screwed on a rod extending through the capacity adjusting slide valve and the internal volume ratio is adjusted by rotating the rod by means of a step motor to slide the internal volume ratio adjusting slide valve. There is also a type in which said rod is rotated manually when the operation of the compressor is stopped and fixed at a appropriate rotation position by a lock nut to secure the internal volume ratio adjusting slide valve in place.

With the conventional screw compressors equipped with an internal volume ratio adjusting slide valve and a capacity adjusting slide valve mentioned above, internal volume ratio and capacity can be adjusted automatically or internal volume ratio can be adjusted manually with the operation of the compressor stopped. Such a compressor can be used for a variety of uses, however, the construction is complicated, which causes increase in cost. Further, an electric power source is required to drive an oil pump or step motor for generating the hydraulic pressure to move the slide valves. Therefore, there is inconvenience that such a compressor can not be used as it is in wild land where electricity can not be available. For example, in natural gas fields, screw compressors are driven by gas engines using extracted natural gas as fuel, and it is troublesome in many cases to provide a electric power source for adjusting internal volume ratio and capacity of the screw compressors.

On the other hand, capacity controllable screw compressors have been used widely for refrigerating machines. A plurality of compressors have been combined to compress gas through a plurality of compressors, for example, two or three compressors to reduce the compression ratio per one stage for improving compression efficiency, for polytropic efficiency is low if it is intended to attain high compression ratio (ratio of discharge pressure to suction pressure) by a single compressor.

Generally, in a screw compressor, the internal volume ratio is determined in the design stage, and a compressor of proper internal volume ratio is selected among compressor specifications of low, intermediate, and high compression ratio depending on uses. The selected compressor achieves maximum polytropic efficiency under a certain operating condition, i.e. at a certain compression ratio, and polytropic efficiency decreases at compression ratios other than that. This is for the wasteful work needed to be done when the compressor is operating at the compression ratio other than the compression ratio corresponding to the internal volume ratio of the selected compressor, because a pressure difference is developed between the pressure in the discharge space and that of the gas to be discharged into said space from the compression space formed by a pair of rotors of the compressor.

There have been developed screw compressors capable of adjusting internal volume ratio and capacity, however, they are inevitably complicated in structure and high in cost as mentioned above.

When a plurality of conventional compressors with constant internal volume ratio, for example, two of such compressors are combined to attain high compression ratio, one is a lower pressure compressor and the other is a higher pressure compressor. The lower pressure compressor compresses sucked gas at the compression ratio corresponding with the design internal volume ratio determined in the design stage of the lower pressure compressor and discharges the compressed gas to the inlet side of the higher pressure compressor.

The higher pressure compressor compresses the gas discharged from the lower pressure compressor at the compression ratio corresponding with the design internal volume ratio determined in the design stage of the higher pressure compressor.

Therefore, the suction pressure of the higher pressure compressor (intermediate pressure) depends on the ratio of the volume of the enclosed space between teeth of the lower pressure compressor when discharge from the space begins to the volume of the enclosed space between teeth of the higher pressure compressor when compression begins, i.e. the volume of the maximum enclosed space between teeth of the higher pressure compressor.

To be more specific, if the volume of the enclosed space between teeth of the lower pressure compressor when discharge begins is smaller than the volume of the enclosed space between teeth of the higher pressure compressor when compression begins, the gas discharged from the lower pressure compressor is enclosed in the space between teeth which is larger than the space between teeth of the lower pressure compressor when discharge begins, so that the pressure of the gas when compression begins in the higher pressure compressor is lower than that when the gas is discharged from the lower pressure compressor. That is, the intermediate pressure (suction pressure of the higher pressure compressor) becomes lower than the discharge pressure of the lower pressure compressor. Therefore, the gas discharged from the lower pressure compressor expands in the space between the lower pressure compressor and higher pressure compressor, that means that the lower pressure compressor compresses the gas excessively high and does wasteful compression work, resulting in decreased efficiency of the lower pressure compressor.

Now if we call the ratio (the volume of the enclosed space between teeth of the lower pressure compressor when discharge begins)/(the volume of the enclosed space between teeth of the higher pressure compressor when compression begins) as displacement ratio, the smaller the displacement ratio is, the lower the intermediate pressure becomes, resulting in excessively high compression in the lower pressure compressor.

It is desirable to operate the combined compressor unit so that said displacement ratio is kept to be 1 or slightly smaller than 1 to evade large pressure drop when the discharged gas from the lower pressure compressor enters the suction port of the higher pressure compressor.

The discharge pressure of a screw compressor is $(V_i)^m$ times the suction pressure, where $V_i$ is internal volume ratio, and m is polytropic exponent. Assuming polytropic exponent m is 1.3, when design internal volume ratio is 2.5, discharge pressure is 3.29 for suction pressure of 1.0, 4.94(=3.29×1.5) for suction pressure of 1.5, and 6.58(=3.29×2) for suction pressure of 2. If these discharge pressure of the lower pressure compressor are the suction pressure of the higher pressure compressor, and assuming polytropic exponent m is 1.3 and design internal volume ratio is 2.5 also in the higher pressure compressor, discharge pressure of the higher pressure compressor is 10.8, 16.2, and 21.6 for suction pressure of the lower pressure compressor of 1, 1.5, and 2 respectively.

As described above, when the suction pressure of the lower pressure compressor increases, the discharge pressure of the higher pressure compressor increases considerably, and there happens the case that the discharge pressure exceeds the limit pressure permissible for the higher pressure compressor, which may induce damage of the components of the higher pressure compressor.

When the displacement ratio is small, the intermediate pressure, i.e. the suction pressure of the higher pressure compressor becomes lower than the discharge pressure of the lower pressure compressor (the pressure in the enclosed space between teeth just before discharge begins), but even so, the discharge pressure of the higher pressure compressor may happen to exceed the permissible pressure when suction pressure (the suction pressure of the lower pressure compressor) is highly increased. The larger the design internal volume ratio is, the stronger this tendency is.

SUMMARY OF THE INVENTION

An object of the present invention is to provide a screw compressor of simple structure and low cost equipped with slide valves for adjusting internal volume ratio and capacity (the flow rate of discharge gas) without the need of providing an electric power source, the screw compressor being composed such that the sliding and securing in place of the internal volume ratio adjusting slide valve and the sliding of the capacity adjusting slide valve can be operated manually.

Another object of the present invention is to provide a combined compressor unit for achieving high compression ratio with superior efficiency, which can accommodate the variation in suction and discharge pressure.

To attain the first object, a screw compressor equipped with an internal volume ratio adjusting slide valve and a capacity adjusting slide valve is provided, wherein the capacity adjusting slide valve having a cut in the discharge side end part thereof for defining radial port and having a center female screw hole is screwed on a male screw thread part of a valve driving shaft, the internal volume ratio adjusting slide valve having a center hole is supported for sliding on said valve driving shaft in the suction side from the capacity adjusting slide valve, the internal volume ratio adjusting slide valve is pushed toward the capacity adjusting slide valve by an elastic member supported in the suction side bearing housing, and a fixing means for securing the internal volume ratio adjusting slide valve in place is provided; and wherein internal volume ratio is adjusted through securing the internal volume ratio adjusting slide valve in place by means of said fixing means and capacity is adjusted through sliding the capacity adjusting slide valve by rotating said valve driving shaft.

It is preferable that said internal volume ratio adjusting slide valve is provided with a plurality of radial holes in the direction radial from the outer perimeter thereof, the holes being arranged along the direction of sliding, said fixing means is a pin plug to be screwed into one of female screw holes provided in the suction side bearing housing and/or rotor casing so that the pin part of the pin plug is inserted into one of said radial holes, and said valve driving shaft is extended to the outside of the suction side bearing housing to be provided with a handle at the end thereof for rotating the valve driving shaft to slide the capacity adjusting slide valve.

When the compressor is used with the operating condition changing not so much, it is not necessary to adjust internal volume ratio and capacity (the flow rate of discharge gas) frequently and automatically. Considering the case a screw compressor with fixed internal volume ratio (designed internal volume ratio) is used in a natural gas field for example, suction pressure gradually decreases because of reduced pressure decreasing with the aging of the gas well. It is necessary to supply gas at constant pressure, so the discharge pressure of the compressor must be kept at the pressure initially decided. Therefore, it is necessary in such a case to increase internal volume ratio of the screw compressor to accommodate the reduction in suction pressure.

According to the present invention, as the capacity adjusting slide valve is screwed on a male screw thread part of a valve driving shaft, the internal volume ratio adjusting slide valve is supported for sliding on said valve driving shaft in the suction side from the capacity adjusting slide valve, and the internal volume ratio adjusting slide valve is pushed by an elastic member toward the capacity adjusting slide valve, the internal volume ratio adjusting slide valve is always kept in contact with the capacity adjusting slide valve when the internal volume ratio adjusting slide valve is not secured in place and the capacity adjusting slide valve is not moved toward the discharge side. Accordingly, when the internal volume ratio adjusting slide valve is to be moved toward the suction side, that is when to reduce internal volume ratio, the internal volume ratio adjusting slide valve is moved together with the capacity adjusting slide valve by moving the capacity adjusting slide valve toward the suction side by rotating the valve driving shaft, and when the internal volume ratio adjusting slide valve is to be moved toward the discharge side, that is when to increase internal volume ratio, the internal volume ratio adjusting slide valve is moved toward the discharge side by moving the capacity adjusting slide valve toward the discharge side by rotating the valve driving shaft because the internal volume ratio adjusting slide valve is always pushed toward the capacity adjusting slide valve by the elastic member. Therefore, when the internal volume ratio adjusting slide valve is not secured in place, the internal volume ratio adjusting slide valve and the capacity adjusting slide valve can be moved in any direction together by rotating the valve driving shaft. If the capacity adjusting slide valve is moved toward the discharge side by rotating the valve driving shaft when the internal volume ratio adjusting slide valve is secured in place, the amount of discharged gas decreases.

As to the means for securing the internal volume ratio adjusting slide valve in place, a variety of structures can be considered, and it is preferable that the internal volume ratio adjusting slide valve is provided with a plurality of radial holes in the direction radial from the outer perimeter thereof, the holes being arranged along the direction of sliding, said fixing means consist of a plurality of female screw holes provided in the suction side bearing housing and/or rotor casing and a pin plug to be screwed into one of said female screw holes so that the pin part of the pin plug is inserted into one of said radial holes on the internal volume ratio adjusting slide valve. The positions of said radial holes on the outer perimeter of the internal volume ratio adjusting slide valve along the direction of sliding and the positions of said screw holes in the suction side bearing housing and/or rotor casing are determined to correspond with the predetermined internal volume ratios. With the construction like this, the internal volume ratio adjusting slide valve can be easily secured in place by screwing the pin plug into one of the screw holes so that the pin part of the pin plug is inserted into on of the radial holes on the outer perimeter of the internal volume ratio adjusting slide valve. The selection of the position to insert the pin part of the pin plug can be easily performed, for the internal volume ratio adjusting slide valve can be moved in any direction of sliding by rotating the valve driving shaft as mentioned above.

It is preferable that at least one female screw holes is provided in each of the bearing housing and rotor casing, and the screw holes are plugged up with blank plugs except the screw hole into which the pin plug for securing the internal volume ratio adjusting slide valve in place is screwed in.

As the internal volume ratio adjusting slide valve extends over part of the rotor casing and suction side bearing housing, if, for example, the screw holes are provided only in the suction side bearing housing, the radial holes on the outer perimeter of the internal volume ratio adjusting slide valve must be located on the outer perimeter of the part of the internal volume ratio adjusting slide valve always existing in the suction side bearing housing, which results in a large length of the internal volume ratio adjusting slide valve. By providing the screw holes divided in the suction side bearing housing and rotor casing, said radial holes can be provided on the outer perimeter of the internal volume ratio adjusting slide valve on the part which protrudes inside the rotor casing, and the length of the internal volume ratio adjusting slide valve can be reduced.

It is also possible to construct the screw compressor such that the internal volume ratio adjusting slide valve can be secured in arbitrary positions.

As has been described in the forgoing, according to the present invention, internal volume ratio of the screw compressor can be adjusted simply by tightening the pin plug to secure the internal volume ratio adjusting slide valve in place when the pin part of the pin plug is inserted into one of the radial holes on the internal volume ratio adjusting slide valve corresponding to a desired internal volume ratio among the predetermined ratios while rotating the rotation handle manually, and capacity can be adjusted by rotating the handle after the internal volume ratio adjusting slide valve is secured in place.

The second object of the invention is attained by combining a plurality of screw compressors including at least a compressor according to the present invention to form a compressor unit.

The unit consists of course of compressors for lower pressure and higher pressure. For example, when the unit consists of two compressors, a lower pressure compressor and a higher pressure compressor, the discharge port of the lower pressure compressor is connected to the suction port of the higher pressure compressor. In this case, the screw compressor according to the present invention is adopted as the lower pressure compressor and a conventional screw compressor with constant inner volume ratio is adopted as the higher pressure compressor, so the compression ratio of the higher pressure compressor is constant and that of the lower pressure compressor can be varied. When suction pressure is high, the inner volume ratio of the lower pressure compressor is reduced to decrease the discharge pressure of the lower pressure compressor to evade excessively high-pressure gas supply to the suction port of the higher pressure compressor, thus the over load of the higher pressure compressor can be evaded. When the suction pressure of the lower pressure compressor is low, the inner volume ratio of the lower pressure compressor is increased to keep the discharge pressure of the higher pressure compressor at a required pressure. Generally, it is desirable to operate the higher pressure compressor in full load, that is, with the maximum capacity thereof, for the efficiency of the compressor reduces with decreased load. When the internal volume ratio of the lower pressure compressor is varied, the discharge volume of the lower pressure compressor varies. For example, when the internal volume ratio of the lower pressure compressor is decreased, the discharge volume of the lower pressure compressor increases, which may cause the displacement ratio to become larger than 1. In the case like this, the capacity (flow rate) of the lower pressure compressor is decreased by sliding the capacity adjusting slide valve to keep the displacement ratio to 1 or slightly smaller than 1. Thus, by adopting the screw compressor of the present invention for at least one of the combined compressor unit, the unit can accommodate the high suction pressure and low suction pressure while keeping the efficiency of the unit as high as possible by keeping the displacement ratio to 1 or slightly smaller than 1 while evading overloading the higher pressure compressor when suction pressure is high.

When the capacity adjusting slide valve of the lower pressure compressor is adjusted to operate the unit in part load, that is, to decrease gas flow rate, the internal volume ratio adjusting slide valve of the lower pressure compressor and the capacity adjusting slide valve of the higher pressure compressor are adjusted to keep the displacement ratio to 1 or slightly smaller than 1.

As to the adjusting of the internal volume ratio and capacity, a proper adjustment can easily be done manually based on the measurements of pressures, temperatures, and flow rate of gas by preparing a simplified chart to find out necessary adjustment.

When the screw compressor of the present invention is adopted as the higher pressure compressor too, the required compression ratio of the unit can be apportioned properly to the lower and higher pressure compressor. The volumetric efficiency of screw compressor decreases with the increase in compression ratio, so it is more advantageous to apportion the required compression ratio to the compressors of the unit as evenly as possible than to apportion higher compression ratio to some compressors and lower compression ratio to the other compressors of the unit.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
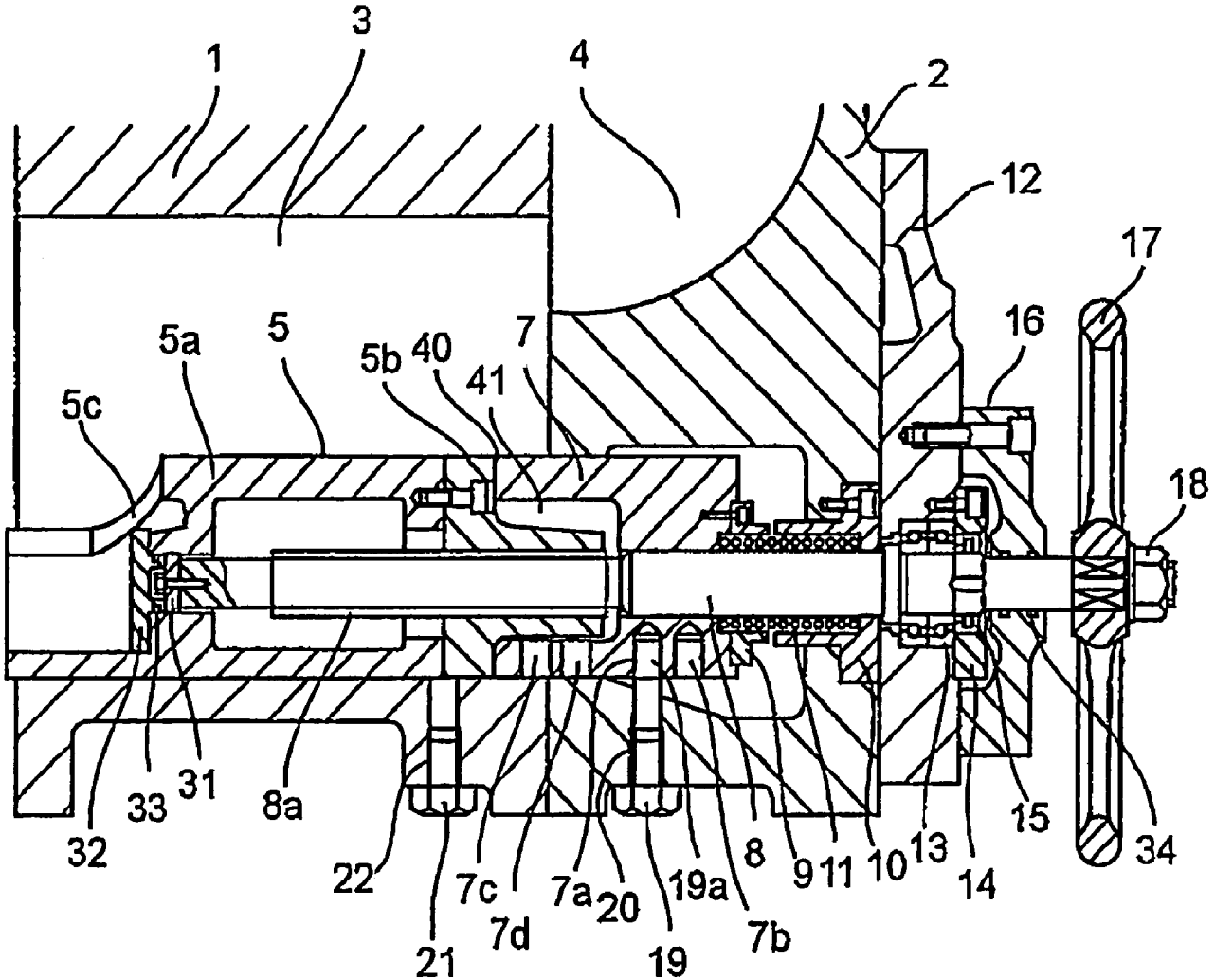
FIG. 1 is a longitudinal sectional view showing the structure of the part where the internal volume adjusting slide valve and capacity adjusting slide valve are mounted of the screw compressor according to the present invention.

FIG. 1 is a longitudinal sectional view showing the structure of the part where the internal volume adjusting slide valve and capacity adjusting slide valve are mounted of the screw compressor according to the present invention. Referring to FIG. 1, reference numeral 1 is a rotor casing, 2 is a suction side bearing housing, 3 is the rotor chamber in the rotor casing 1 in which a male and female rotors (not shown in the drawing) meshing with each other are accommodated, the rotors being supported by bearings in a suction side bearing housing and a discharge side bearing housing not shown in the drawing. Reference numeral 5 is a capacity (the flow rate of discharge gas) adjusting slide valve consisting of a radial port valve 5*a* and a screwed guide member 5*b* connected to the radial port valve 5*a* by means of screws. The screwed guide member 5*b* having a center female screw hole is screwed on a male screw thread part 8*a* of a capacity adjusting slide valve driving shaft 8. The radial port valve 5*a* has a cut 5*c* at the left, i.e. the discharge side end part for defining a radial port. Reference numeral 7 is an inner volume ratio adjusting slide valve having a center hole and supported for sliding on the capacity adjusting slide valve driving shaft 8 in the right side, i.e. the suction side from the screwed guide member 5*b*. The left end part of the valve driving shaft 8 is supported by means of a centering plate 31 attached to the radial port valve 5*a* of the capacity adjusting slide valve 5 and the right end part thereof is supported by a cover 12 attached to the suction side bearing housing 2 by means of a set of bearings 13. The valve drive shaft 8 further extends rightward and a rotation handle 17 is attached at the end thereof by means of a nut 18. The capacity adjusting slide valve 5 and inner volume ratio adjusting slide valve 7 are shaped to have curved surfaces running along the outer perimeters of the male and female rotors to form part of the rotor casing on the upper side and semi-cylindrical surfaces on the lower side. The part where the inner volume ratio adjusting slide valve is inserted of the suction side bearing housing 2 is formed to match the outer contour of the slide valve. The inner volume ratio adjusting slide valve 7 is forced toward the capacity adjusting slide valve 5 by a coil spring 11.

Reference numeral 9 is a spring guide attached to the inner volume ratio adjusting slide valve 7, 10 is a spring guide attached to the suction side bearing housing 2. Reference numeral 15 is a nut for fastening the inner race of the bearing 13, 14 is a plate for retaining the outer race of the bearing 13, 16 is a cover, 34 is an o-ring, 32 is an end cover of the valve driving shaft 8, and 33 is an o-ring.

Radial holes 7*a*~7*d* are provided in the lower, semi-cylindrical part of the internal volume ratio adjusting slide valve 7. The internal volume ratio adjusting slide valve 7 can be secured in the suction side bearing housing 2 or rotor casing 1 by inserting the pin part 19*a* of a pin plug 19 into one of the radial holes 7*a*~7*d*. Assuming that internal volume ratio can be set, for example, to 2.3, 2.63, 3.65, and 5.0 in the case of FIG. 1, the state in FIG. 1 in which the pin part 19*a* of the pin plug 19 screwed into the screw hole 20 is inserted into the radial hole 7*a* is the state that internal volume ratio is set to 2.3. If the internal volume ratio adjusting slide valve 7 is moved to the left and the pin part 19*a* of the pin plug 19 is inserted into the radial hole 7*b*, internal volume ratio is increased to 2.63. Then when the blank plug 21 is removed and the pin plug 19 is screwed into the screw hole 22 in the rotor casing 1, if the pin part 19*a* is inserted into the radial hole 7*c*, internal volume ratio is increased to 3.65, and if the pin part 19*a* is inserted into the radial hole 7*d*, internal volume ratio is increased to 5.0.

When the rotation handle 17 is rotated to slide the capacity adjusting valve 5 to the left in the state the internal volume ratio adjusting slide valve 7 is secured in place, the capacity adjusting slide valve moves away from the contact face 40 and there is formed a clearance between the left end face of the internal volume ratio adjusting slide valve 7 and the rear face of the flange part of screwed guide member 5*b* which is fixed to the radial port valve 5*a*. Then, a part of the gas sucked in the space between teeth leaks off to a chamber 41 and returns to the suction passage 4 through a passage not shown in the drawing. Therefore, the volume of the enclosed gas in the space between teeth when the space is closed by the rear face side edge line of the flange part of the screwed guide member 5*b* running along the outer perimeter of the rotors, decreases and the amount of discharge decreases. The state the rear face of the flange part of the screwed guide member 5*b* is in contact with the left end face of the internal volume ratio adjusting slide valve 7, is the state of full load, i.e. of maximum flow rate of discharge gas. The flow rate decreases with the increase of the travel of the capacity adjusting valve 5 toward the left, i.e. toward the discharge side.

To increase internal volume ratio from 2.3 to 2.63, first the pin plug 19 is loosened to draw out the pin part 19*a* from the radial hole 7*a*, and the rotation handle 17 is turned to move the capacity adjusting slide valve 5 to the left. The internal volume ratio adjusting slide valve 7 moves to the left together with the capacity adjusting slide valve 5 because the internal volume ratio adjusting slide valve 7 is always forced toward the capacity adjusting slide valve 5 by the coil spring 11. When the pin part 19*a* is inserted into the radial hole 7*b*, the pin plug 19 is fastened tightly.

When internal volume ratio is set to 5.0, the pin plug 19 is screwed into the screw hole 22 instead of the blank plug 21, the pin part 19*a* is inserted into the radial hole 7*d*, and the blank plug 21 is screwed into the screw hole 20. To change internal volume ratio from 5.0 to 2.2, first the blank plug 21 and the pin plug 19 are removed, the pin plug 19 is screwed halfway in the screw hole 20, the rotation handle 17 is turned to move the capacity adjusting slide valve 5 toward the right together with the internal volume ratio adjusting slide valve 7 until the pin part 19*a* of the pin plug 19 fits into the radial hole 7*a*, the pin plug 19 is fastened, and the blank plug is fastened to the screw hole 22.

In this way, the internal volume ratio adjusting slide valve 7 can be slid by turning the rotation handle 17 when to increase and also to decrease internal volume ratio, so that it is easy to allow the pin part f the pin plug to fit into a proper radial hole. Although in this example four internal volume ratios are predetermined, it is evident that a plurality of internal volume ratios other than four can be predetermined.

Figure 2:
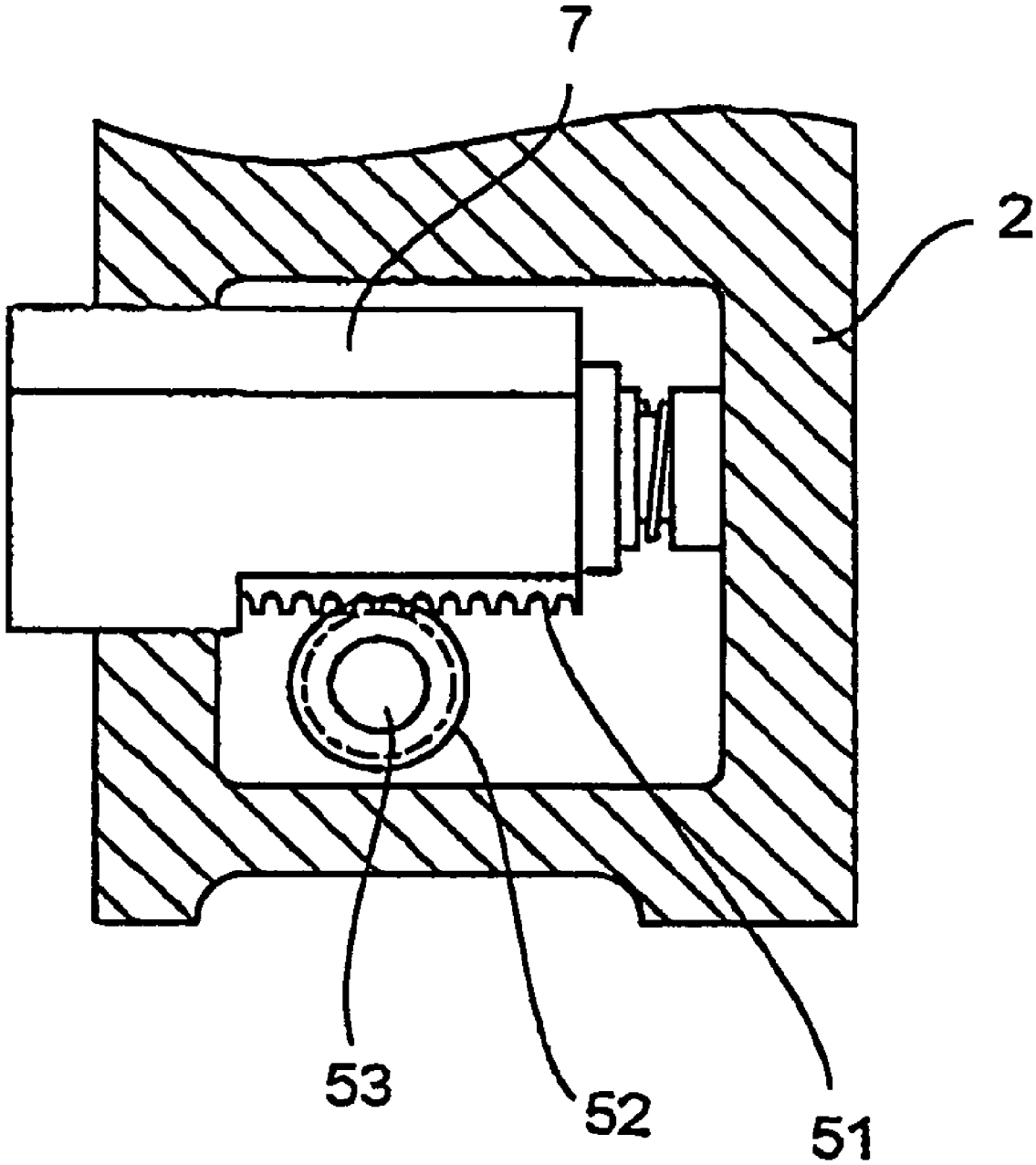
FIG. 2 is an illustration showing the mechanism of securing the internal volume ratio adjusting slide valve in arbitrary positions.

FIG. 2 is an illustration showing the mechanism of securing the internal volume ratio adjusting slide valve in arbitrary positions. In FIG. 2, a rack 51 is attached to the internal volume ratio adjusting slide valve 7 on the lower peripheral part thereof and a pinion 52 meshing with the rack 51 is fixed to a pinion shaft 53 supported in the suction side bearing housing 2. When the internal volume ratio adjusting slide valve 7 is slid by turning the rotation handle 17 (see FIG. 1), the pinion 52 meshing with the rack 51 is rotated and also the pinion shaft 53 is rotated. The pinion shaft 53 is extended to the outside of the suction side bearing housing 2 where it can be locked of rotation by means not shown in the drawing. By the locking of the pinion shaft 53, the internal volume ratio adjusting slide valve 7 is secured in any place arbitrarily. It is also possible to slide the internal volume ratio adjusting slide valve 7 by turning the pinion shaft 53 instead of turning the rotation handle 17.

Figure 3:
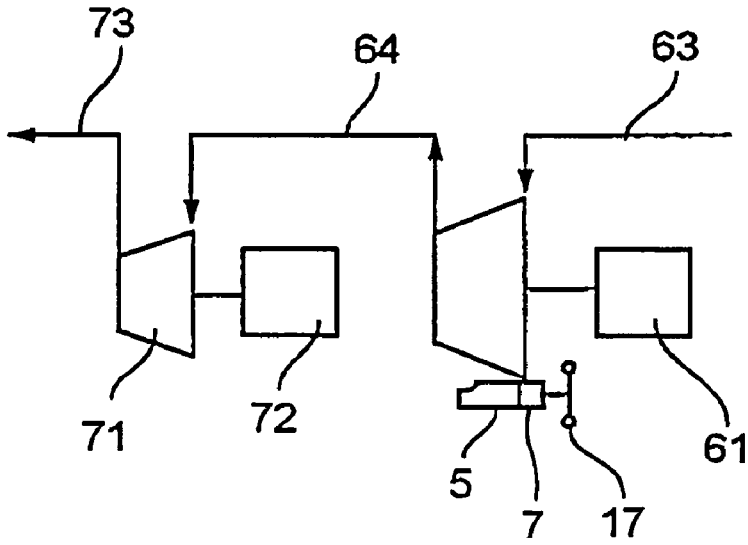
FIG. 3 is a block diagram of an embodiment of a combined screw pressure unit consisting of two screw compressors including the screw compressor of the present invention.
Figure 4:
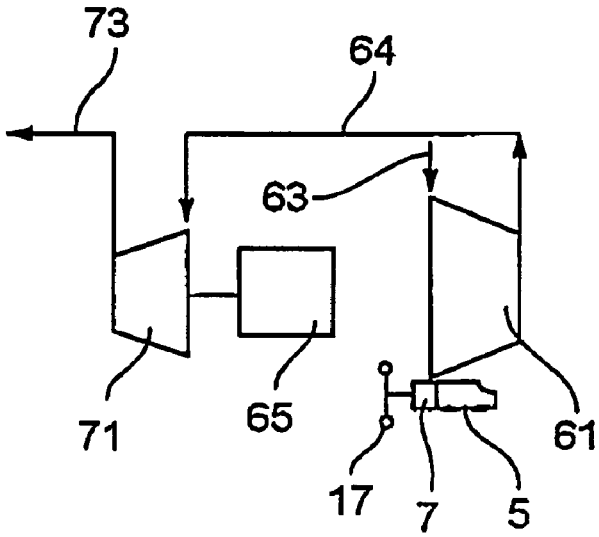
FIG. 4 is a block diagram of another embodiment of a combined screw pressure unit consisting of two screw compressors including the screw compressor of the present invention.
Figure 5:
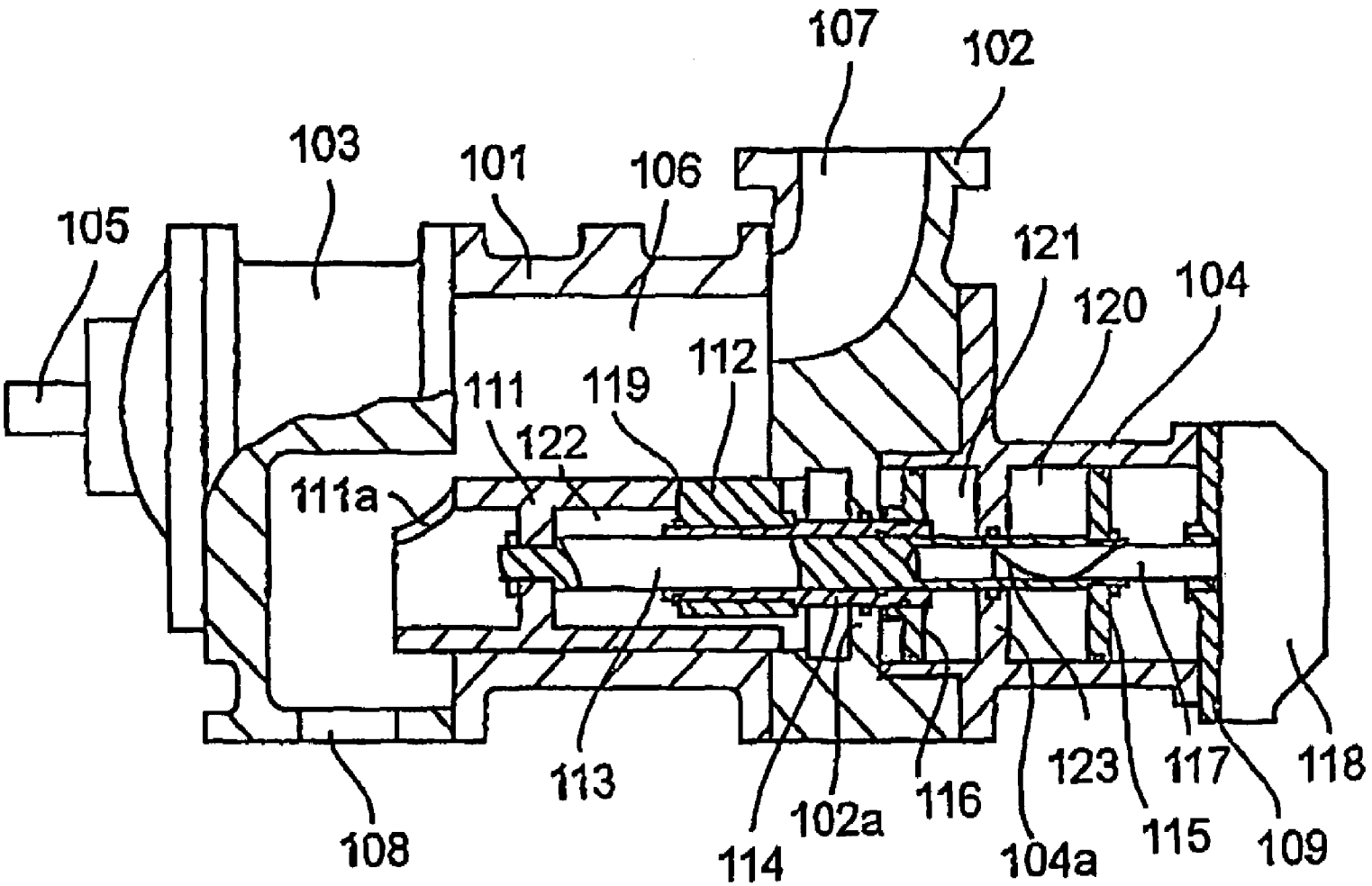
FIG. 5 is a partially sectional view of an example of a conventional screw compressor equipped with an internal volume ratio adjusting slide valve and a capacity adjusting slide valve.

FIG. 3 is a block diagram of an embodiment of a combined screw pressure unit consisting of two screw compressors including the screw compressor of the present invention, and FIG. 4 is a block diagram of another embodiment of a combined screw pressure unit consisting of two screw compressors including the screw compressor of the present invention.

In FIG. 3, reference numeral 61 is a lower pressure compressor, 62 is a driving machine of the lower pressure compressor 61, 71 is a higher pressure compressor, 72 is a driving machine of the higher pressure compressor 71. Reference numeral 63 is a suction line, 64 is a intermediate line, and 73 is a discharge line of the combined unit. Reference numeral 5, 7, and 17 indicate respectively the capacity adjusting slide valve, internal volume ratio adjusting slide valve, and rotation handle of FIG. 1. The lower pressure compressor 63 is a screw compressor according to the present invention equipped with an internal volume ratio adjusting slide valve and a capacity adjusting slide valve and the higher pressure compressor 71 is a conventional screw compressor usually equipped only with a capacity adjusting slide valve. The combined screw compressor unit can accommodate the variation in suction pressure and discharge pressure as explained before while keeping the displacement ratio to 1 or slightly smaller than 1 and evading overloading the higher pressure compressor due to high suction pressure.

FIG. 4 shows an another embodiment of a combined screw compressor unit, in which a driving machine 65 drives both the lower pressure compressor 61 and higher pressure compressor 71. When gas engines are adopted for driving the compressors, an engine of the type having front drive is adopted.

It is suitable that the higher pressure compressor 71 is also the screw compressor of the present invention. In this case, the compression ratio required to the unit can be apportioned as evenly as possible because the compression ratio of the higher pressure compressor 71 can also be adjusted, resulting in improved volumetric efficiency of each of the compressors.

Although in FIG. 3 and FIG. 4 is shown the case the unit consists of two compressors, it is evident that the above explanation can be applied to the case the unit consists of more than two compressors.

What is claimed is:

1. A screw compressor equipped with an internal volume ratio adjusting slide valve and a capacity adjusting slide valve, wherein the capacity adjusting slide valve having a cut in the discharge side end part thereof for defining radial port and having a center female screw hole is screwed on a male screw thread part of a valve driving shaft, the internal volume ratio adjusting slide valve having a center hole is supported for sliding on said valve driving shaft in the suction side from the capacity adjusting slide valve, the internal volume ratio adjusting slide valve is pushed toward the capacity adjusting slide valve by an elastic member supported in the suction side bearing housing, and a fixing means for securing the internal volume ratio adjusting slide valve in place is provided, and wherein internal volume ratio is adjusted through securing in place the internal volume ratio adjusting slide valve by means of said fixing means and capacity is adjusted through sliding the capacity adjusting slide valve by rotating said valve driving shaft.

2. The screw compressor according to claim 1, wherein said internal volume ratio adjusting slide valve is provided with a plurality of radial holes in the direction radial from the outer perimeter thereof, the holes being arranged along the direction of sliding, said fixing means is a pin plug to be screwed into one of female screw holes provided in the suction side bearing housing and/or rotor casing so that the pin part of the pin plug is inserted into one of said radial holes, and said valve driving shaft is extended to the outside of the suction side bearing housing to be provided with a handle at the end thereof for rotating the valve driving shaft to slide the capacity adjusting slide valve.

3. The screw compressor according to claim 2, wherein at least one female screw hole is provided in each of the bearing housing and rotor casing, and the screw holes are plugged up with blank plugs except the screw hole into which the pin plug for securing the internal volume ratio adjusting slide valve in place is screwed in.

4. The screw compressor according to claim 1, wherein said fixing means is constructed such that a rack is attached to the internal volume ratio adjusting slide valve and a pinion meshing with the rack is fixed to a pinion shaft supported for rotation in the suction side bearing housing, the pinion shaft being able to be locked of rotation to secure the internal volume ratio adjusting slide valve in arbitrary positions.

5. A combined screw compressor unit consisting of a plurality of screw compressors in which the discharge port of one compressor is connected to the suction port of the other one to form a multi stage compressor unit, wherein the unit includes at least a screw compressor according to any one of claim 1 to 4.

* * * * *